United States Patent [19]

Hanset

[11] Patent Number: 4,468,170

[45] Date of Patent: Aug. 28, 1984

[54] LOW LEVEL INDICATOR

[75] Inventor: Richard E. Hanset, Santa Cruz, Calif.

[73] Assignee: Beta Technology, Inc., Santa Cruz, Calif.

[21] Appl. No.: 385,434

[22] Filed: Jun. 7, 1982

Related U.S. Application Data

[63] Continuation-in-part of Ser. No. 167,705, Jul. 11, 1980, abandoned.

[51] Int. Cl.[3] ..... F04B 49/06; H01H 35/34

[52] U.S. Cl. ..... 417/44; 417/63; 200/83 J; 200/83 W

[58] Field of Search ..... 200/819 R, 83 J, 83 W, 200/83 A; 417/63, 44

[56] References Cited

U.S. PATENT DOCUMENTS

| | | | |
|---|---|---|---|
| 974,328 | 11/1910 | Aalborg | 200/83 J |
| 2,468,768 | 5/1949 | Malick | 200/81.9 R |
| 2,719,889 | 10/1955 | Miller | 200/81.9 R |
| 2,765,743 | 10/1956 | Hollinshead | 417/44 |
| 2,910,940 | 11/1959 | Colman et al. | 417/63 X |
| 2,953,659 | 9/1960 | Edwards | 200/81.9 R X |
| 3,448,434 | 7/1969 | Nolte, Jr. et al. | 200/83 R X |
| 3,799,702 | 3/1974 | Weishaar | 417/477 |
| 3,842,224 | 10/1974 | Weis | 200/81.9 R |
| 4,049,935 | 9/1977 | Gruber | 200/83 A X |
| 4,227,862 | 10/1980 | Andrew et al. | 417/12 |
| 4,257,748 | 3/1981 | Ives et al. | 417/63 |

*Primary Examiner*—William L. Freeh
*Assistant Examiner*—T. Olds
*Attorney, Agent, or Firm*—Robert G. Slick

[57] ABSTRACT

A low level indicator and warning device is provided wherein a diaphragm is provided directly in a line for drawing liquid from one container to another. Liquid flowing in the line washes directly across the diaphragm so that it remains clean and thus operative even in the presence of materials which might form a crust on the diaphragm.

2 Claims, 6 Drawing Figures

LOW LEVEL INDICATOR

REFERENCE TO RELATED APPLICATION

This application is a continuation-in-part of my prior application Ser. No. 167,705 filed July 11, 1980, now abandoned.

SUMMARY OF THE INVENTION

In many applications a liquid is drawn from one vessel to another and it is essential to provide a positive indicator means showing whether a sufficient level of the liquid has been maintained in a reservoir to ensure an adequate supply of the additive. A common application of such a device is in a dishwasher wherein the additive is a cold sterilizing agent, such as a sodium hypoclorite solution, and wherein health regulations require that there be a positive indicator that the additive had been added. If the dishwasher were allowed to complete its cycle and the additive reservoir were empty, a dangerous condition would be produced since the dishes would not be properly sterilized.

Various suggestions have been made in the past for indicators, such as sight glasses, thermistors or floats in the fluid reservoir. Such simple devices are not always positive in operation since they are subject to encrustation, clouding and sticking. Thus, there may be a false indication with a clouded sight glass, a hung-up float or a coated thermistor.

Another suggestion made in the prior art is to provide an upwardly extending arm from the suction line which is connected to an adjustable diaphragm. Further, the suggestion has been made that restriction be placed in the upwardly extending arm to prevent a momentary false actuation. In operation, such devices depend upon the fact that as liquid is pulled out of the reservoir a vacuum must necessarily exist on the upwardly extending arm and that this vacuum can be used to actuate the diaphragm depending upon the presence or absence of vacuum in the line. Such a system has several inherent disadvantages. For one thing, upon release of the vacuum when the pump is operating, liquid will be drawn into the upwardly extending arm which may cause no harm the first time, or first few times, it happens. However, this may cause the arm and/or diaphragm to become encrusted or plugged which prevents the diaphragm from flexing in response to vacuum or air pressure. Thus if any liquid is drawn into the line, the operation of the device eventually becomes erratic. Further, if a restriction is placed in the line leading to the diaphragm to prevent momentary false actuation, the situation is actually made worse rather than better since any liquid drawn into the line will be retained in the line for a longer time hastening the encrustation. The problem is particularly severe if a very viscous or highly concentrated liquid is being handled.

In accordance with the present invention the above objections have been obviated by providing a system wherein a flexible diaphragm is provided directly in the supply line which diaphragm is actuated by both the static and dynamic negative pressure produced by drawing upward on a column of liquid. The entire surface of the diaphragm is in the line of flow and there is no constriction between the diaphragm and the line. Normally the diaphragm is larger than the line so that flow past the diaphragm is turbulent, increasing the cleaning action of the liquid against the diaphragm.

In accordance with a preferred embodiment of the present invention, an anvil-like stop is placed in the line opposite the diaphragm. Although this is primarily to prevent excessive excursion of the diaphragm, it also serves to break up the flow and promotes a turbulent flow across the diaphragm which further aids in preventing encrustation.

Another advantage of the system in the present invention is that it is capable of handling very viscous and highly concentrated materials which would clog other systems. The flexible diaphragm of the indicator employed in carrying out the present invention is washed by liquid flowing past it and also it flexes and solidified material breaks off from it without clogging it.

The diaphragm employed in the present structure is extremely strong and can be subjected to extreme overloads without altering its effectiveness.

Various other features and advantages of the invention will be brought out in the balance of the specification.

DESCRIPTION OF THE PREFERRED EMBODIMENTS

Figure 1:
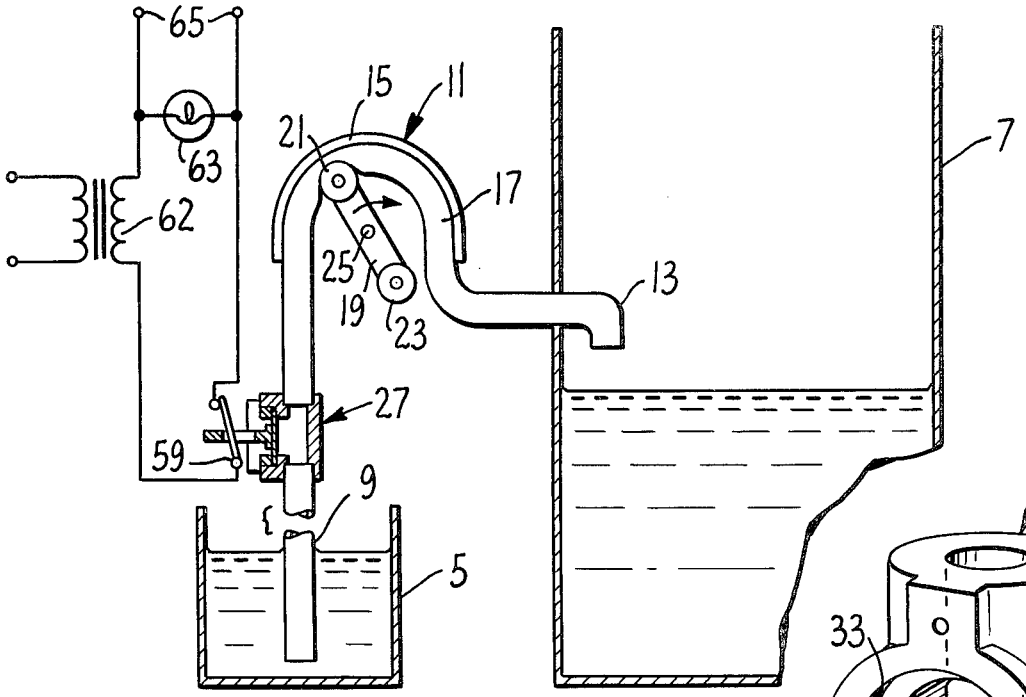
FIG. 1 is a side view, partly in section, of a low warning indicator embodying the present invention.
Figure 2:
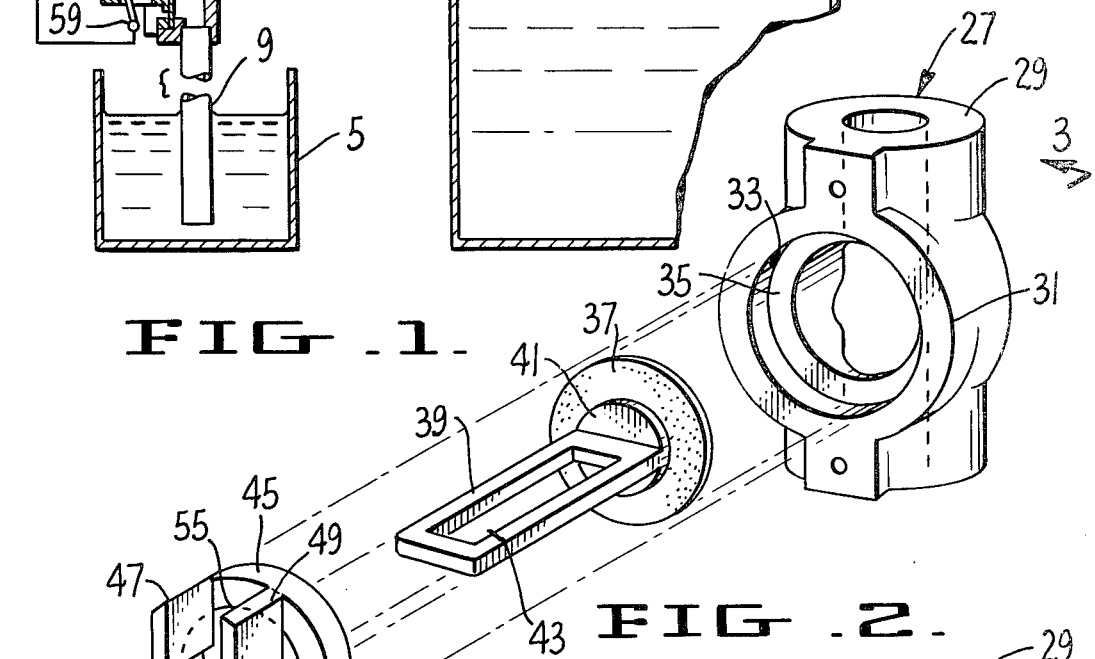
FIG. 2 is an exploded view of the novel diaphragm actuated switch employed in carrying out the present invention.
Figure 3:
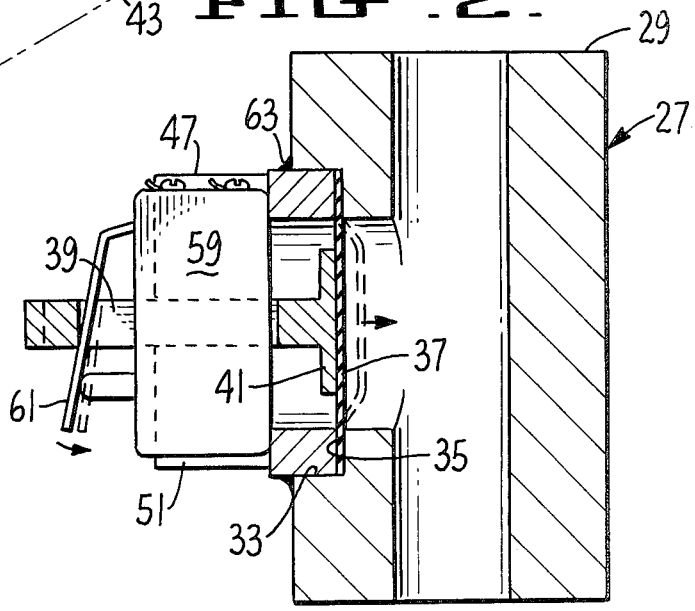
FIG. 3 is an enlarged section on the line 3—3 of FIG. 2.

Referring now to FIGS. 1–3 of the drawings by reference characters, there is shown a reservoir 5 containing a liquid which one wishes to transfer into a vessel 7. A typical application would be a situation where 5 is a reservoir containing a sterilant such as sodium hypochlorite and 7 is a dishwasher. In order to transfer the liquid, a line 9 dips into the liquid and it is drawn through line 9 by means of a peristalic pump, generally designated 11 and discharged into vessel 7 through line 13. The peristalic pump consists of an arcuate backplate 15, a flexible tube 17 lying against the plate and with a rotor 19 carrying two or more rollers 21 and 23 which are driven by shaft 25. As is well known, the rollers squeeze the tube and cause a pumping action without any physical contact between the rotor and the material being pumped as would be the case in more conventional pumps.

In accordance with the present invention, a diaphragm actuated switch, generally designated 27 is provided in line 9. The switch includes a coupling 29 having a shoulder 31 with a relatively large opening 33 in the shoulder and a recessed retaining rim 35. A diaphragm 37 is provided of a thin, flexible elastomer which is resistant to any chemicals which might be used in the system. The size of the diaphragm is such that it fits within the opening 33 and rests against the rim 35. As is apparent from the drawings, liquid flowing through line 9 flows directly along the diaphragm and there is no constriction between the diaphragm and the line. Also apparent from the drawing is the fact that the diaphragm is substantially in the line of flow. An actuating arm 39 is attached to diaphragm 37 by means of disc 41 which can be fastened to the diaphragm with a suitable adhesive. The actuating arm 39 has an elongated slot 43 formed therein. A collar 45 is provided which has an outer diameter corresponding with the diameter of opening 33 and an inner diameter of such size that it will rest against the rim 35. Collar 45 has four upstanding lugs designated 47, 49, 51 and 53 arranged as shown to provide a large cross opening 55 and a small cross opening 57. The large cross opening 55 is of such a size as to accomodate a miniature switch 59, such as one sold under the trade name Microswitch, the switch having an actuating arm 61 thereon. The device is assembled, as is best seen in FIG. 3, preferably using a suitable adhesive 63 so that arm 61 rests within the rectangular opening 43.

Switch 59 is of the momentary contact normally closed type and is wired in series with a source of electricity 61 and an indicator 63. In the embodiment illustrated, indicator 63 is a light but it could be an audible or other warning device. Terminals 65 could be utilized to actuate an additional warning device or a cut off device to stop the action of a washing machine or the like. With the parts in a position as shown in FIG. 1 and with shaft 25 stopped, switch 59 will be closed so that the warning light is on. Now, assuming that there is liquid in the reservoir 5 and shaft 25 is started, the rotor 19 will revolve in the direction shown by the arrow, creating suction on line 9 and drawing liquid up through the line where it will be ultimately discharged through line 13. However, as suction is placed on the line 9, diaphragm 37 will be drawn in from the position shown in solid lines in FIG. 3 to the position shown in dashed lines, which will retract arm 39 bringing pressure to bear on arm 61 of switch 59 overcoming the spring force of the switch, opening switch 59 and causing the indicator 63 to go off, showing that there is a safe condition.

Figure 4:
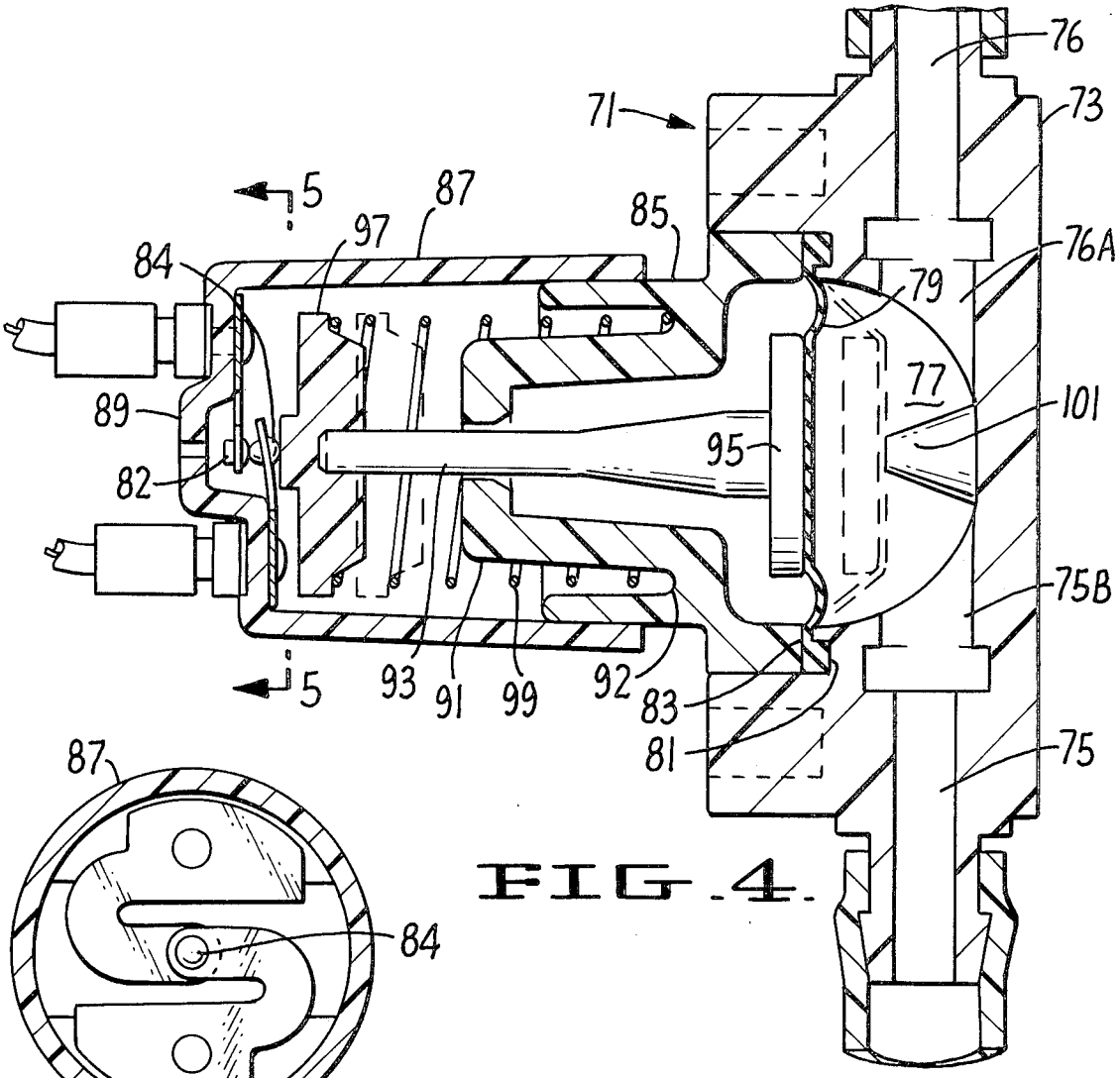
FIG. 4 is a side view, partly in section, of another embodiment of the low warning indicator of the present invention.
Figure 5:
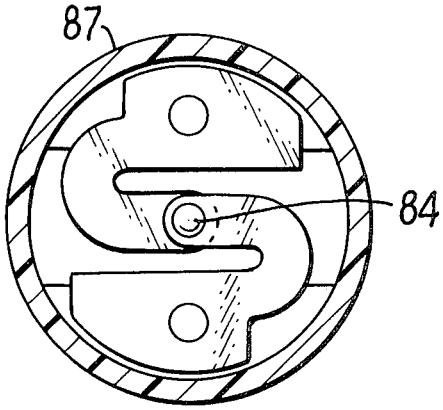
FIG. 5 is a section on the line 5—5 of FIG. 4.
Figure 6:
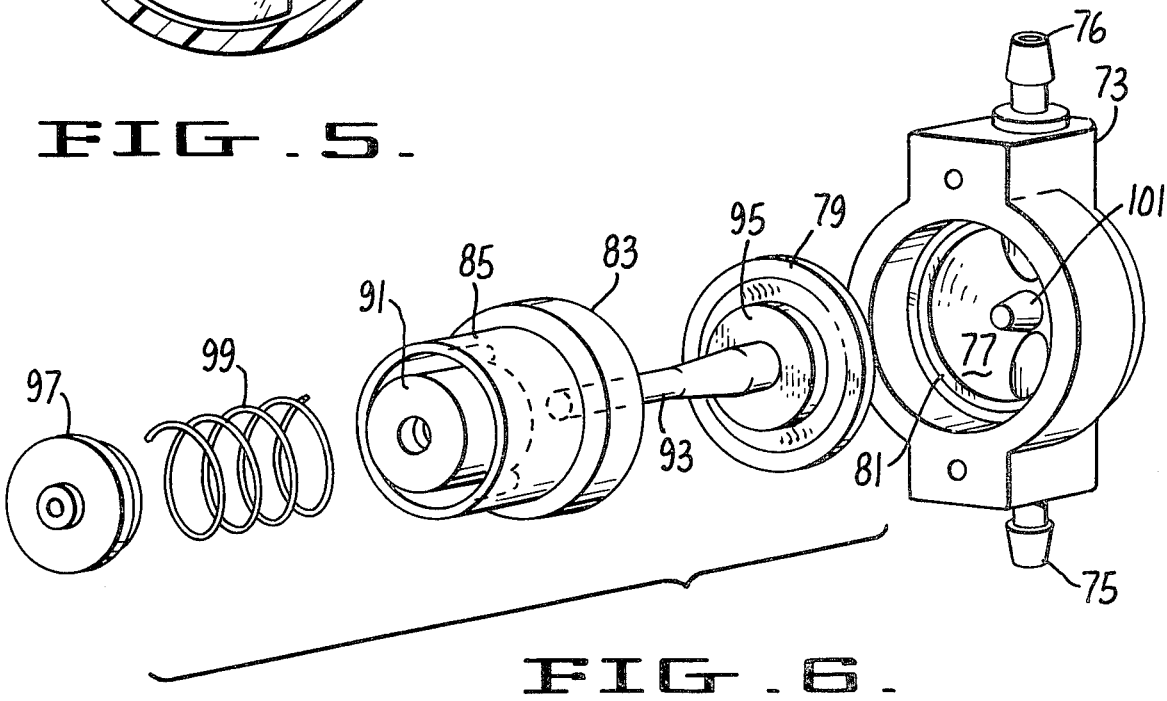
FIG. 6 is a partial exploded view of the low warning indicator of FIGS. 4 and 5.

FIGS. 4–6 illustrate another embodiment of the invention and, although the exact mechanism is somewhat different, the principle of operation is exactly that previously described. The switch generally designated 71 is employed exactly like switch 27 previously described. In this embodiment of the invention, a coupling 73 has a relatively small tubular inlet 75 and outlet 76 which lead to the enlarged sections 76A and 76B, respectively, both of which connect to a large central chamber 77 which is thus in the line of flow. At one side of this chamber is placed a diaphragm 79 held in place between a groove 81 on coupling 73 and a collar 83 which forms part of a cap 85. Fitting over cap 85 is a sleeve 87 having an end 89 of an insulating material which holds the normally open contacts 81 and 84.

Forming part of the cap 85 is the internal guide 91 through which rod 93 forms an easy sliding fit. At one end of rod 93 is a piston 95 which is fastened with a suitable adhesive to diaphragm 79. Piston 95 is somewhat smaller than the diaphragm 95 to allow the diaphragm to have some freedom of movement. At the opposite end of rod 93 is a spring retainer 97 and a spring 99 fits between this retainer and a groove 92 in the cap 85. Normally spring 99 biases rod 93, and the associated parts, to the left, as shown in FIG. 4, to the position shown in solid lines. However, whenever there is a negative pressure within the chamber 77, i.e. when liquid is being drawn from a reservoir, the diaphragm 79 and associated parts are drawn to the right as is shown in dash lines in FIG. 4. Thus, when there is no pressure in the line, which would indicate a failure such as an empty reservoir, the contacts 82 and 84 will be closed, as previously described, while if there is a negative pressure in the line, i.e. when liquid is being drawn from a reservoir under suction, the contacts will be open as is shown in dash lines.

A stop 101 is preferably provided within the chamber 77 to prevent an excessive excursion and possible breakage of diaphragm 79. Further the stop is in the line of flow and thus increases turbulence across the diaphragm, lessening the chances of encrustation.

It will be noted from the drawings that the liquid flowing through the chamber 77 is in direct contact and flows along diaphragm 79. It will also be noted that there is no constriction between chamber 77 and the diaphragm. Thus, the diaphragm is constantly bathed or washed in the flowing liquid so that any material which might tend to form an encrustation on the diaphragm would be washed away. Thus, the warning device or switch of the present invention is adapted to be used in the presence of viscous, caustic, highly concentrated or any other materials which would render diaphragm switches of the type heretofore known inoperative.

Although it is preferred to operate the low level device of the present invention with a peristalic pump, it can be actuated by any type of pump in which case it would normally be necessary to employ a check valve in the line.

It is obviously necessary that the column of liquid below diaphragm switch 27 or 71 be long enough to pull in on the diaphragm. This will depend to some extent on the flexibility of the diaphragm and the specific gravity of the liquid. Normally if the diaphragm switch 27 or 71 is located 13 to 15 inches above the highest level expected in reservoir 5, the operation will be satisfactory.

Although the device of the present invention was designed primarily as a safety device for use with a sterilizing solution in dishwashers and clothes washers it will be apparent to those skilled in the art that the invention is of much broader application and can be used in any situation wherein it is necessary to monitor a liquid level and make sure that the reservoir from which the solution is being drawn is not empty.

The subject matter to be claimed is:

1. In a device wherein a liquid is drawn from a reservoir of said liquid by means of a pump, a low level warning device comprising in combination:

a. a suction line dipping into the liquid in a reservoir from which a quantity of liquid is to be withdrawn, b. a diaphragm opposite a central chamber in said line, the entire surface of said diaphragm being directly in the line of flow of said liquid whereby liquid flows in direct turbulent contact across the surface of the diaphragm and there is no constriction between said line and said diaphragm, c. a switch actuated by said diaphragm, said diaphragm being drawn in when suction is placed on said line and liquid is in said reservoir and said diaphragm moving out when a column of liquid is not maintained below said diaphragm whereby d. outward movement of said diaphragm actuates a switch and said switch actuates a warning device, and stop means in said central chamber opposite said diaphragm for preventing excessive excursions of said diaphragm and for promoting liquid turbulence across said diaphragm.

2. The device of claim 1 wherein the diameter of said diaphragm is larger than the diameter of said line creating turbulent flow across said diaphragm.

* * * * *